United States Patent [19]

Wally

[11] Patent Number: 4,523,902

[45] Date of Patent: Jun. 18, 1985

[54] DIAPHRAGM PUMP FOR USE IN AN EXPLOSIVE ATMOSPHERE

[75] Inventor: Michael Wally, Bammental, Fed. Rep. of Germany

[73] Assignee: Chemie und Filter GmbH Verfahrenstechnik KG, Heidelberg, Fed. Rep. of Germany

[21] Appl. No.: 459,790

[22] Filed: Jan. 21, 1983

[30] Foreign Application Priority Data

Jan. 23, 1982 [DE] Fed. Rep. of Germany ..... 3202069

[51] Int. Cl.[3] ..... F04B 17/04; F04B 43/04; F01B 19/02; F16J 1/10

[52] U.S. Cl. ..... 417/410; 417/413; 417/417; 92/101; 92/129

[58] Field of Search ..... 417/413, 417, 410; 92/101, 129; 74/110, 18.2; 308/DIG. 8

[56] References Cited

U.S. PATENT DOCUMENTS

| | | | |
|---|---|---|---|
| 1,987,257 | 1/1935 | Kent et al. | 417/413 |
| 2,835,831 | 5/1958 | Harrington | 417/413 |
| 2,898,860 | 8/1959 | Grober | 417/413 |
| 3,153,347 | 10/1964 | Schulze et al. | 417/413 |
| 4,123,122 | 10/1978 | Gabrielson et al. | 308/DIG. 8 |
| 4,421,588 | 12/1983 | Davies | 308/DIG. 8 |

FOREIGN PATENT DOCUMENTS

| | | | |
|---|---|---|---|
| 593400 | 3/1960 | Canada | 417/413 |
| 994846 | 5/1974 | Canada . | |
| 178232 | 9/1953 | Fed. Rep. of Germany | 92/101 |
| 1426858 | 3/1976 | United Kingdom . | |

*Primary Examiner*—Carlton R. Croyle
*Assistant Examiner*—T. Olds
*Attorney, Agent, or Firm*—Peter K. Kontler

[57] ABSTRACT

A fluid flow machine has a diaphragm pump which is driven by an electromagnet and is confined in a pressure-resistant capsule together with the electromagnet as well as with the electronic control unit for the electromagnet. The constituents of the capsule are connected to each other so that they form one or more gaps each having a configuration and dimensions such as to prevent the propagation of flames and/or sparks from the interior of the capsule to the surrounding area. This renders it possible to use the machine in an explosive atmosphere, even if the pump is designed to deliver metered quantities of flammable fluids. A gap of the above outlined character is provided between two portions of the capsule where a reciprocable plunger extends toward the diaphragm. Additional gaps are provided in a removable cover of the capsule at each of several locations where rotary and/or reciprocable adjusting devices extend from the interior of the capsule so that they can be manipulated in order to change the extent of movement of the armature of the electromagnet, to adjust one or more potentiometers or to actuate one or more switches. Further safety gaps can be provided in regions where the terminal or terminals of one or more electric cables extend into the capsule and/or where a light-transmitting cylinder is installed in the capsule to allow for observation of a signal generating device in the interior of the capsule.

28 Claims, 4 Drawing Figures

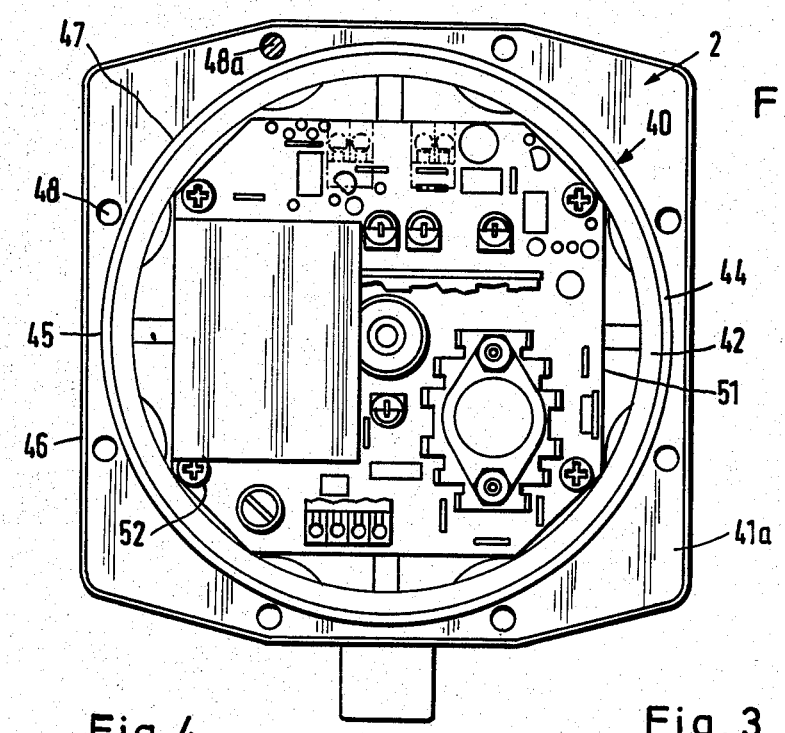
Fig. 2
Fig. 4
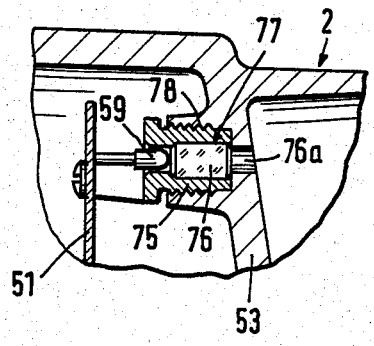
Fig. 3
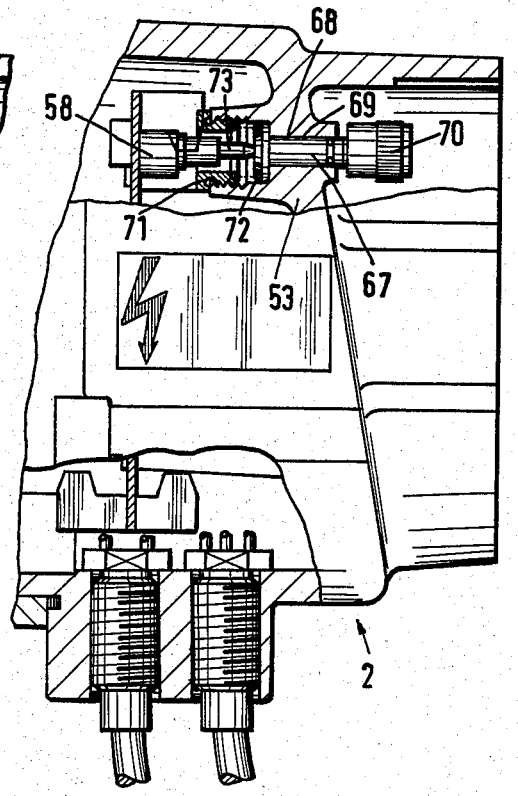

DIAPHRAGM PUMP FOR USE IN AN EXPLOSIVE ATMOSPHERE

BACKGROUND OF THE INVENTION

The present invention relates to fluid flow machines in general, and more particularly to improvements in motor-pump aggregates wherein the pump is a diaphragm pump which can be used to advance metered quantities of a liquid, gas or otherwise flowable medium. Still more particularly, the invention relates to improvements in fluid flow machines wherein the diaphragm of the diaphragm pump can be deformed by a motor which can constitute or include an electromagnet and wherein one or more movable parts (e.g., actuating or adjusting devices) extend from the enclosure for the pump and its motor.

It is already known to construct a fluid flow machine of the above outlined character in such a way that the pump head is disposed at one axial end of the enclosure, that the diaphragm in the pump head is deformable by the reciprocable armature of an electromagnet in cooperation with a coil spring or another suitable resilient element, and that the enclosure further contains a control unit which generates and transmits impulses for energization of the electromagnet. A fluid flow machine which embodies a diaphragm pump and is constructed in the above outlined manner is disclosed, for example, in German Pat. No. 23 22 764. The patented machine exhibits the advantage that all essential components (including the pump, the electromagnet and the control unit) are confined in a common enclosure and thus constitute a unitary structure. This contributes to compactness of the machine and facilitates the installation. However, the patented machine also exhibits serious drawbacks, especially that it cannot be set up in an explosive atmosphere because the generation of a single spark or overheating of the electromagnet is likely to touch off a fire, an explosion or a series of explosions in the area around the enclosure for such machine. A spark can develop in that portion of the enclosure which accommodates the electromagnet and/or in the portion which confines the control unit. The possibility of spark generation in certain portions of the structure which is installed in the enclosure of the patented machine cannot be excluded; therefore, such machines are not suited for transport of flammable media and/or for use in areas which contain or are likely to contain explosive or flammable substances. This greatly reduces the usefulness and versatility of the patented machine.

Certain known electromagnetically operated diaphragm pumps are designed with a view to ensure that the electromagnets meet the requirements for "increased safety" in areas containing explosive and/or flammable substances. Reference may be had to the pamphlet No. D-1-400d which describes so-called LEWA metering pumps. The electromagnets of the motors for such pumps are immersed in oil, and the control unit is installed in a separate casing which can be set up at a locus remote from the danger area, namely, far away from the area which is likely to contain explosive or flammable substances. Such solution is cumbersome and expensive, and the installation takes up much time because the casing for the control unit must be mounted independently of the aggregate including the diaphragm pump and its motor.

OBJECTS AND SUMMARY OF THE INVENTION

An object of the invention is to provide a fluid flow machine which is constructed and assembled in such a way that the interior of its enclosure is invariably and reliably sealed from the surrounding atmosphere, even against the transmission of sparks and/or flames in the event of an explosion in the interior of the enclosure.

Another object of the invention is to provide a fluid flow machine which employs one or more diaphragm pumps and which can be installed in areas containing explosive and/or flammable substances without any danger of explosion or fire as a result of the propagation of ignition from the interior of the enclosure into the surrounding atmosphere.

A further object of the invention is to provide a fluid flow machine wherein the control unit can be installed in a common enclosure with the pump and its motor and wherein such mounting of the control unit does not increase the danger of explosion or fire when the machine is installed in an area that contains or is likely to contain flammable and/or explosive substances.

An additional object of the invention is to provide a novel and improved enclosure for use in a fluid flow machine of the above outlined character.

Another object of the invention is to provide novel and improved means for preventing the propagation of ignition in regions where movable parts of the control unit and/or other movable parts extend from the enclosure of the fluid flow machine.

A further object of the invention is to provide a fluid flow machine which is at least as compact as heretofore known fluid flow machines with a common enclosure for the pump, motor and controls but whose safety factor in an explosive atmosphere is incomparably higher than that of heretofore known fluid flow machines.

Another object of the invention is to provide a novel and improved method of joining various constituents of the enclosure which forms part of the above outlined fluid flow machine.

The invention is embodied in a fluid flow machine, e.g., for conveying combustible liquids. The machine comprises a diaphragm pump, especially a metering pump, means for driving the pump including electromagnet means, and a common enclosure for the pump and the driving means. The enclosure constitutes a pressure-resistant capsule and includes a main portion, a cover, and means for securing the cover to the main portion. The cover and the main portion define a gap which is configurated and dimensioned to prevent the propagation of ignition (flames and/or sparks) between the interior of the enclosure and the surrounding atmosphere. The main portion is preferably formed with a first cylindrical surface and the cover has a second cylindrical surface; one of these surfaces surrounds the other surface and the gap is disposed between the two surfaces. The arrangement may be such that the cover includes a tubular extension having an external surface which constitutes the second cylindrical surface, and that the main portion includes a tubular end portion having an internal surface which constitutes the first cylindrical surface. The main portion can be formed with a further surface which may constitute a circumferentially complete end face, and the cover can be formed with an annular shoulder which constitutes an additional surface abutting against the end face and forming therewith a radially outwardly extending second gap connecting the first mentioned gap with the atmosphere. The first surface is then adjacent to the radially innermost portion of the end face, and the second surface is then adjacent to the radially innermost portion of the shoulder.

The external surface of the enclosure can include a polygonal portion (e.g., a portion which is provided on the cover) and the first mentioned gap can include first and second portions which are respectively nearer to and more distant from the polygonal portion of the peripheral surface. The aforementioned securing means can comprise bolts, screws or analogous fasteners having shanks received in bores or holes which are machined into the cover between the second portion of the first mentioned gap and the polygonal portion of the external surface.

The main portion of the enclosure includes a first part which surrounds at least a portion of the pump and a second part which surrounds at least a portion of the electromagnet means. The pump includes a diaphragm and the driving means further includes means for deforming the diaphragm. Such deforming means preferably includes a plunger-like motion transmitting member which receives motion from the electromagnet means and extends from the second part into the first part of the main portion of the enclosure. The motion transmitting member and the main portion define a third gap which is configurated and dimensioned to prevent the propagation of ignition between the interior of the first part and the interior of the second part. The motion transmitting member is reciprocable with reference to the main portion of the enclosure, and the machine preferably further comprises bearing means (such as an antifriction ball bearing) which is adjacent to the third gap and serves to reciprocably guide the motion transmitting member. The deforming means preferably further comprises a cupped second member which is interposed between the motion transmitting member and the diaphragm, and a coil spring or other suitable means for yieldably biasing the cupped member against the motion transmitting member. The electromagnet means includes a reciprocable armature and the motion transmitting member is located between the second member and the armature and is in contact with the second member and the armature exclusively under the action of the biasing means. The motion transmitting member preferably consists of a high-quality alloy, e.g., hardened stainless steel. The biasing means reacts against the enclosure (e.g., against an internal shoulder of the aforementioned first part) and bears against the cupped second member to bias the latter against the motion transmitting member. The bottom wall of the cupped member is connected to the diaphragm and the motion transmitting member preferably extends into the interior of the cupped second member so that the inner side of the bottom wall can be maintained in contact with the motion transmitting member under the action of the biasing means. A friction bearing, which spacedly surrounds the third gap and preferably constitutes a compound bronze-plastic bearing, is preferably installed between the cupped member and the main portion of the enclosure. A deformable ring-shaped membrane can be provided to sealingly connect the cupped second member to the enclosure, preferably to the first part of the main portion of the enclosure. The cupped second member can be made of a high-grade metallic material, e.g., steel. The main portion of the enclosure can be provided with at least one opening which allows for gravitational outflow of fluids intermediate the diaphragm and the third gap. Such fluids can enter the corresponding portion of the enclosure in response to destruction and/or dislodging of the diaphragm whose marginal portion can be clamped between two sections of the first part of the main portion of the enclosure.

The machine can further comprise at least one adjusting device which extends from the enclosure and defines with the latter a fourth gap which is configurated and dimensioned to prevent the propagation of ignition between the interior of the enclosure and the surrounding atmosphere. The adjusting device is preferably formed with a cylindrical external surface and the enclosure has a bore surrounded by a cylindrical internal surface. The fourth gap is disposed between such cylindrical surfaces. The bore can be provided in an end wall of the cover. The adjusting device can serve to adjust an adjustable element in the interior of the enclosure and, to this end, the machine preferably comprises coupling means which connects the adjusting device with the adjustable element and is located in the interior of the enclosure. The coupling means is preferably designed to allow for at least some play between the adjusting device and the adjustable element. The adjustable element can constitute a mobile portion of an on-off switch in the enclosure. If the switch is activated and deactivated in response to axial movement of the adjustable element, the adjusting device is movable axially in the bore of the enclosure and the machine can further comprise a coil spring or other suitable resilient means for urging the adjusting device axially of the bore and away from the adjustable element so that the adjusting device normally assumes a predetermined starting position and is ready to be depressed by an operator in order to turn the switch on or off. Alternatively, the adjusting device and the adjustable element can be mounted for rotation about the axis of the bore, and the coupling means then preferably includes at least one forked torque transmitting portion. For example, the coupling means can comprise a plug-in torque transmitting connection between the adjusting device and the adjustable element.

The machine can further comprise optical signal generating means (e.g., a light-emitting diode) which is installed in the enclosure and the latter is then formed with an observation window which is in line with the signal generating means. The machine then further comprises a light-transmitting device which is installed in the window and defines with the enclosure an additional gap which is configurated and dimensioned to prevent the propagation of ignition between the interior of the enclosure and the surrounding atmosphere. The window can constitute a bore which is machined into the aforementioned end wall of the cover and the cover has a cylindrical internal surface cooperating with a cylindrical external surface of the light-transmitting device to define the aforementioned additional gap. The light-transmitting device can constitute an elongated solid cylinder of glass, artificial glass or any other suitable light-transmitting material.

Still further, the machine can comprise heat-conducting means which connects one end portion of the electromagnet means to a wall of the main portion of the enclosure, e.g., to a wall which is a component of the aforementioned second part of the main portion. The second end portion of the electromagnet means is then preferably adjacent to a heat sensor which is installed in the enclosure and is preferably designed to effect an interruption of connection between the winding or windings of the electromagnet means and the energy source in response to overheating of the respective end portion of the electromagnet means.

The novel features which are considered as characteristic of the invention are set forth in particular in the appended claims. The improved fluid flow machine itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 2 is an end elevational view of the cover, as seen from the left-hand side of FIG. 1;

FIG. 3 is a fragmentary axial sectional view of the cover, showing a switch and the actuating or adjusting means therefor; and FIG. 4 is a fragmentary axial sectional view of the cover, showing the mounting of a light-emitting device which is observable from the outer side of the end wall of the cover.

DESCRIPTION OF THE PREFERRED EMBODIMENTS

Figure 1:
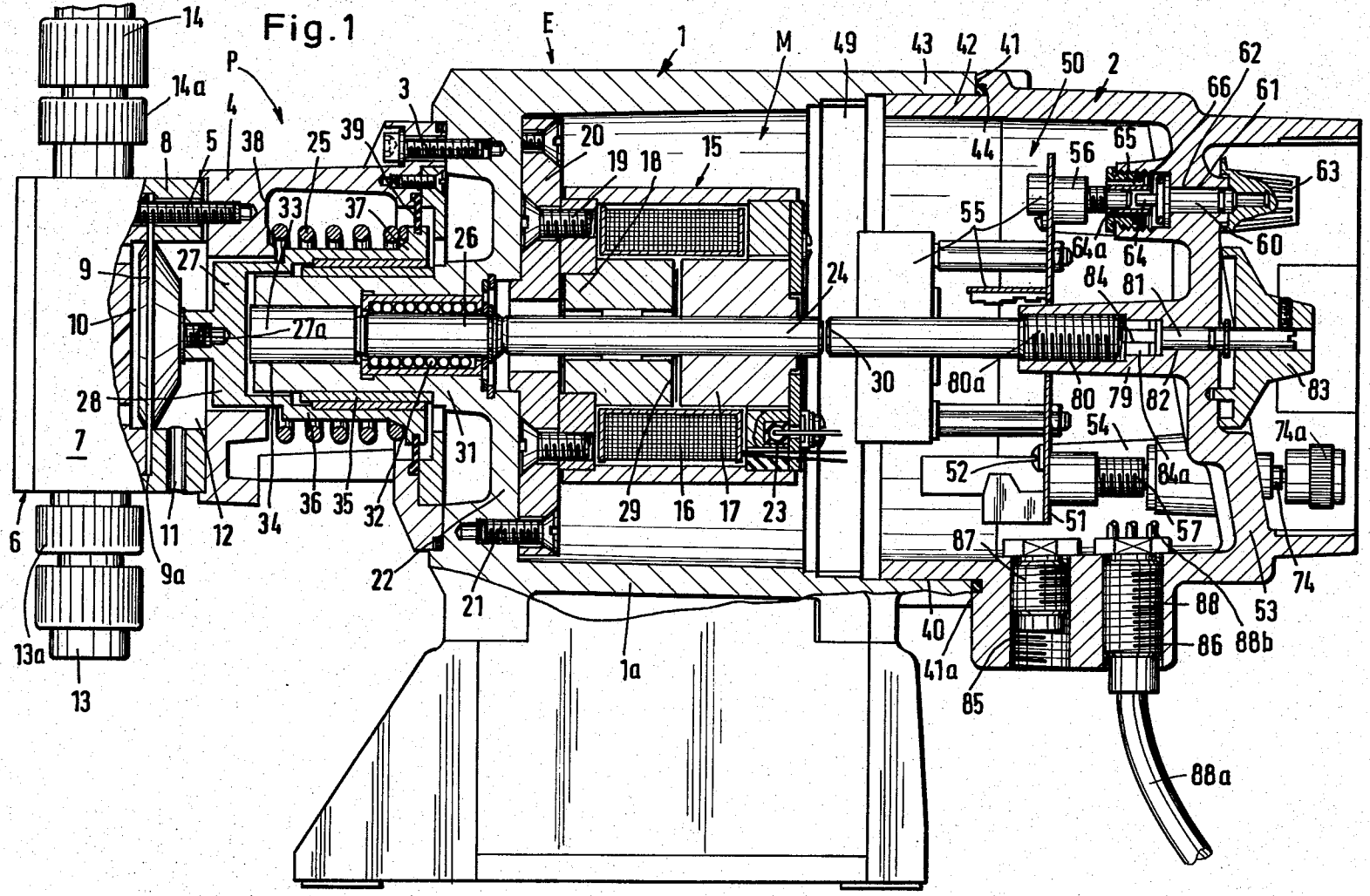
FIG. 1 is a somewhat schematic partly elevational and partly axial sectional view of a fluid flow machine which includes a diaphragm pump and is constructed and assembled in accordance with the present invention.

Referring first to FIG. 1, there is shown a fluid flow machine including a pump P and a pump driving means or motor M. These components of the machine have a common composite enclosure or housing E. The open right-hand end portion of the main portion 1 of the enclosure E (as viewed in FIG. 1) is sealed by a cover 2 which, together with the main portion 1, constitutes a pressure-resistant capsule confining the pump P, the motor M and several adjustable elements which are installed in the interior of the capsule. The main portion 1 of the enclosure E includes a tubular first part 4, 6 which is secured to the adjacent second part 1*a* of the main portion 1 by an annulus of screws 3, bolts or analogous fasteners. The first part includes a component 4 which is installed between the part 1*a* and a component 6 which is also an element of the first part and constitutes a pump head secured to the component 4 by a set of axially parallel screws 5, bolts or similar fasteners. The pump head 6 includes two abutting sections 7 and 8 which clampingly engage the marginal portion 9*a* of a deformable diaphragm 9 serving to subdivide the interior of the head 6 into a pumping chamber 10 and a second chamber 12 communicating with the atmosphere by way of an opening 11 here shown as a bore or port extending downwardly through the lower half of the section 8 so that any flowable medium which happens to penetrate into the chamber 12 can leave the latter by gravity flow. The means for admitting a flowable medium into the pumping chamber 10, when the volume of this chamber is increased in response to rightward deformation of the median portion of the diaphragm 9, includes a suction pipe 13 which is connected to the section 7 by a nipple 13*a*. A pressure line 14, which receives flowable medium from the pumping chamber 10 when the median portion of the diaphragm 9 is deformed in a direction to reduce the volume of the chamber 10, is connected with the section 7 by a nipple 14*a*. Each of the nipples 13*a*, 14*a* contains one or more check valves, e.g., a pair of ball check valves. Reference may be had to the commonly owned copending application Ser. No. 459,785 filed Jan. 21, 1983 for "Diaphragm pump". The disclosure of this copending application is incorporated herein by reference.

The part 1*a* of the main portion 1 surrounds the motor M which comprises or constitutes an electromagnet 15 with an exciter coil 16, a reciprocable core 17 and a yoke 18. The latter is secured to a plate-like carrier 20 by screws 19 or analogous fasteners. The plate-like carrier 20 is heat-conductively secured to the end wall 22 of the part 1*a* by a set of screws 21 or similar fasteners. A safety device in the form of a heat sensor 23 is installed at that axial end of the electromagnet 15 which is remote from the wall 22. The purpose of the heat sensor 23 is to interrupt the connection between the coil 16 and the source of electrical energy when the temperature of the electromagnet 15 and in the part 1*a* reaches a maximum permissible value. The core 17 surrounds and moves a reciprocable rodlike armature 24. The left-hand end face of the armature 24 abuts against the adjacent end face of a motion transmitting member in the form of a plunger 26 having a larger-diameter portion 33 which abuts against the inner side of a bottom wall 28 forming part of a reciprocable cupped cylindrical member 27. The latter further includes a cylindrical portion 36 surrounding a friction bearing 35 which, in turn, surrounds a sleeve-like extension 31 of the wall 22. A resilient element 25, here shown as a coil spring which surrounds the cylindrical portion 36 of the cupped member 27, reacts against an internal surface 38 of the part 4 and bears against an external flange 37 of the cylindrical portion 36 to thus bias the end wall 28 against the end portion 33 of the plunger 26 so that the latter is in permanent face-to-face contact with the armature 24. The smaller-diameter portion of the plunger 26 is reciprocable in an antifriction ball or roller bearing 32 which is installed in the sleeve 31 of the wall 22. The plunger 26 preferably consists of steel. The central portion of the bottom wall 28 of the cupped member 27 is secured to the median portion of the diaphragm 9 by one or more screws 27*a* or the like. To this end, a centrally located stub of the end wall 28 extends into the chamber 12 of the pump head 6. The three coaxial components 24, 26, 27 always move as a unit, even though they are not positively coupled to one another, because the coil spring 25 permanently urges these components in a direction to the right, as viewed in FIG. 1, and into abutment with an adjustable stop 30. The components 24, 26, 27 move against a fixed stop 29 in the part 1*a* when the electromagnet 15 is energized so that the core 17 (to which the armature 24 is attached) moves the plunger 26 (and hence the cupped member 27) to or even slightly beyond the illustrated position.

The sleeve 31 preferably forms an integral part of the wall 22, i.e., of the part 1*a*. The cylindrical internal surface of the sleeve 31 and the cylindrical external surface of the larger-diameter portion 33 of the plunger 26 define a very narrow cylindrical gap 34 of such axial length and width that the gap prevents the penetration of ignition (flame and/or sparks) in either axial direction. The bearing 32 ensures that the plunger 26 is accurately centered in the sleeve 31, i.e., that the width of the gap 34 is constant all the way around the portion 33. An antifriction bearing is preferred for the plunger 26 because such bearing is less likely to undergo expansion as a result of heating; localized expansion of the bearing 32 could lead to changes in the width of corresponding portions of the gap 34. Moreover, overheating of a properly lubricated antifriction bearing is highly unlikely. The friction bearing 35 between the sleeve 31 and the cylindrical portion 36 of the cupped member 27 is preferably a compound bronze-plastic bearing. As mentioned above, the coil spring 25 reacts against the internal surface 38 of the component 4 and bears against the radially outwardly extending flange 37 of the cylindrical portion 36 to invariably maintain the bottom wall 28 in contact with the larger-diameter portion 33 of the plunger 26. The flange 37 is reciprocably but sealingly connected with the component 4 by a ring-shaped flexible membrane 39. One of the purposes of the membrane 39 is to prevent penetration of dust, moisture and/or other contaminants into the region of the friction bearing 35.

A second cylindrical gap 40 is provided between the cylindrical external surface of a smaller-diameter tubular extension 42 of the cover 2 and the cylindrical surface of a tubular end portion 43 of the part 1*a*. The radially extending surface or end face 41 of the end portion 43 abuts against an external surface or shoulder 41*a* of the cover 2 at one axial end of the cylindrical gap 40. The axial length and the width of the gap 40 are selected in such a way that this gap prevents the propagation of ignition from the surrounding atmosphere into the interior of the main portion 1 and/or cover 2, or vice versa. An annular seal 44 is interposed between the end face 41 of the end portion 43 and the adjacent shoulder 41*a* of the cover 2 to prevent the penetration of moisture into the interior of the aforementioned enclosure or capsule E.

As can be seen in FIG. 2, the major portion of the external surface 46 of the cover 2 has a polygonal outline. The diameter of the cylindrical gap 40 is such that certain portions of this gap closely approach the polygonal external surface 46, i.e., the diameter of the gap 40 is as large as possible. One of those portions of the gap 40 which are very closely adjacent to the polygonal external surface 46 of the cover 2 is shown at 45, and one of those portions of the gap 40 which are remote from the adjacent portions of the polygonal external surface 46 is indicated at 47. The cover portions which are outwardly adjacent to the portions 47 of the gap 40 are formed with axially parallel holes or bores 48 for the shanks 48*a* of screws, bolts or analogous securing means or fasteners which serve to urge the end face 41 against the adjacent shoulder 41*a* of the cover 2 and to maintain the seal 44 in proper engagement with the cover as well as with the part 1*a* of the main portion 1 of the enclosure E.

The gap 40 could be defined by two complementary non-cylindrical surfaces. The provision of a cylindrical gap is preferred at this time because the cylindrical external surface of the tubular extension 42 and the cylindrical internal surface of the tubular end portion 43 can be machined with a very high degree of precision so that the width of the cylindrical gap 40 is constant along the entire circumference of the extension 42. A cylindrical gap between the main portion 1 and the cover 2 of the enclosure E is preferred on the additional ground that the length of such gap (as considered in the axial direction of the parts 42 and 43) does not affect the radial dimensions of the corresponding portion of the enclosure. As can be seen in FIG. 1, there is room to make the gap 40 even longer than shown, and this would not necessitate any increase in the wall thickness of the main portion 1 and/or cover 2.

The placing of the gap 40 as close to the polygonal external surface 46 of the cover 2 as possible ensures that there is ample room for installation of a control unit 50 in the internal space 49 of the enclosure E.

The absence of any positive connection between the plunger 26 and the cupped member 27, as well as between the plunger 26 and the armature 24, is considered to be desirable and advantageous because this reduces the likelihood of radial deformation of the plunger and of resulting distortion of the gap 34. Thus, the plunger 26 is merely subjected to axial stresses under the bias of the spring 25 which urges the inner side of the bottom wall 28 of the cupped member 27 against the adjacent end face of the plunger and simultaneously urges the other end face of the plunger against the respective end face of the armature 24. The making of the plunger 26 from a high-quality material, such as hardened stainless steel, also contributes to the formation of a gap 34 whose width remains unchanged for long periods of time. Moreover, stainless steel reduces the likelihood of spark generation. Hardening prolongs the useful life of the plunger.

An important advantage of the cupped member 27 is that it contributes to compactness of the pump P and hence to compactness of the entire fluid flow machine. As shown in FIG. 1, the spring 25 surrounds the cylindrical portion 36 of the cupped member 27, and the bottom wall 28 of this cupped member is directly connected to the median portion of the diaphragm 9. The bottom wall 28 not only transmits motion from the armature 24 to the diaphragm but also moves the parts 26, 24 in a direction to the right, as viewed in FIG. 1, when the spring 25 is permitted to expand on deenergization of the electromagnet 15. Such versatility of the relatively short cupped member 27 renders it possible to reduce the space requirements of that part of the main portion 1 which includes the pump head 6 and the component 4. The cupped member 27 contributes to a reduction of the radial as well as axial dimensions of the pump P. The friction bearing 35 ensures accurate centering of the cupped member 27 on the sleeve 31 of the wall 22. Accurate guidance of the cupped member 27 is desirable and advantageous because this reduces the likelihood of undue and/or unequal stressing of the diaphragm 9 and/or other constituents of the pump P which cooperate with or are merely adjacent to the member 27. Still further, the cupped member 27 surrounds and confines the major part of the plunger 26 so that the plunger 26, as well as the gap 34, is shielded from dust and/or other contaminants. This is achieved by the simple expedient of making the member 27 in the form of a relatively short cup whose bottom wall 28 is installed between the chamber 10 and the plunger 26.

It was further found that a cupped member which is made of high-quality steel can stand long periods of uninterrupted use. Furthermore, the combination of a cupped member 27 which is made of steel and a compound bronze-plastic friction bearing 35 ensures that the member 27 can reciprocate with a minimum of friction, that the member 27 is not likely to generate sparks as a result of its contact with the friction bearing, and that the useful life of such combination is surprisingly long so that the pump P which embodies the combination requires a minimum of attention.

The sensor 23 is installed in that portion of the enclosure E wherein the temperature is most likely to rise to a value which could eventually cause an explosion in the fluid flow machine. The left-hand end portion of the electromagnet 15, as viewed in FIG. 1, is free to exchange heat with the main housing portion 1, namely, with the wall 22, and such main housing portion is or can be provided with heat dissipating ribs. The other end portion of the electromagnet 15 is likely to be first to overheat so that the placing of the sensor 23 at the illustrated location in the interior of the enclosure E constitutes an effective safety measure which ensures that the connection between the coil 16 and the energy source is interrupted well ahead of the time when the pump P is overheated so that a flammable liquid therein would be likely to explode. The sensor 23 can constitute a commercially available thermometer, as long as it is capable of triggering an interruption of the flow of energy to the coil 16 as soon as the temperature therearound reaches a preselected maximum permissible value.

As mentioned above, the opening 11 allows for automatic evacuation of liquid which spills into the chamber 10 in response to partial or complete destruction and/or dislodging of the diaphragm 9. This opening further reduces the possibility of extensive contact between the escaping liquid and the enclosure and keeps the escaping liquid away from the nearest gap 34.

The internal space 49 of the capsule or enclosure E including the main housing portion 1 and the cover 2 accommodates an electronic control unit 50 having a plate 51 which is secured to projections 54 extending inwardly from the end wall 53 of the cover 2. The means for connecting the plate 51 to the projections 54 comprises screws 52 or analogous fasteners. The fixed components or modules 55 of the electronic control unit 50 are mounted at the left-hand side of the plate 51, as viewed in FIG. 1. The right-hand side of the plate 51 supports mobile or adjustable components of the control unit 50, namely, a potentiometer 56 which can be actuated to select the impulse frequency, an on-off switch 57 and, if necessary, a second on-off switch 58 (see FIG. 3) which is accessible from the outer side of the capsule. Furthermore, the plate 51 can carry an optical signal generating device, e.g., a light-emitting diode 59 (shown in FIG. 4).

The potentiometer 56 cooperates with an adjusting device 60 having a reciprocable and/or rotatable shaft which extends, with minimal clearance, through a bore 62 in the end wall 53 of the cover 2 and whose cylindrical external surface defines with the cylindrical internal surface surrounding the bore 62 a cylindrical gap 61 having an axial length and a width such that it prevents the penetration of ignition from the internal space 49 to the surrounding atmosphere or vice versa. The exposed outer end portion of the shaft of the adjusting device 60 carries a knob or wheel 63 which can be grasped by hand when the operator wishes to adjust the potentiometer 56. The inner end portion of the shaft of the adjusting device 60 comprises a forked coupling, portion 64 which cooperates with a complementary coupling portion 64*a* of an adjustable element of the potentiometer 56. A coil spring 66 reacts against a retainer 65 to hold the adjusting device 60 in a predetermined starting position. The device 60 and the adjustable element of the potentiometer 56 are movable axially of the bore 62.

The coupling including the portions 64 and 64*a* is optional, i.e., the adjusting device 60 could be made integral with or could be rigidly connected directly to the adjustable element of the potentiometer 56. The provision of a coupling, with at least some play between its portions 64 and 64*a*, is preferred at this time because it reduces the likelihood of distortion of the adjusting device 60 and hence of the gap 61. At least some play between the portions 64 and 64*a* of the coupling is advisable and advantageous on the additional ground that minor deviations of the position of the potentiometer 56 from an optimum position of attachment to the plate 51 still allow for automatic engagement between the portions 64 and 64*a* when the plate 51 is secured to the projections 54 and the adjusting device 60 is installed in its bore 62.

The switch 58 of FIG. 3 is actuatable by an adjusting device 67 having a cylindrical portion or shaft which extends outwardly through a bore or hole 68 provided therefor in the end wall 53 of the cover 2. The cylindrical external surface of the shaft of the adjusting device 67 and the cylindrical internal surface surrounding the bore 68 define a cylindrical gap 69 having an axial length and a width such that it prevents the propagation of flames or sparks between the internal space 49 of the capsule or enclosure E and the surrounding atmosphere. The exposed outer end portion of the shaft of the adjusting device 67 carries a knob 70 which can be depressed by hand to thereby turn the switch 58 on or off. Depression of the shaft of the adjusting device 67 takes place against the opposition of a coil spring 72 which reacts against a retainer 71. Depression of the knob 70 results in depression of a mobile adjustable element 73 of the switch 58.

The construction of the adjusting means for actuating the switch 57 can be identical with that of the adjusting means for the switch 58. FIG. 1 merely shows the shaft of the axially movable adjusting device 74 and the knob 74*a* which is secured to the exposed end portion of such shaft and corresponds to the knob 70 of FIG. 3.

The absence of a positive connection between the adjusting device 67 and the adjustable element 73 of the switch 58, coupled with the provision of a spring 72 which yieldably urges the adjusting device 67 to its starting position, again allows for at least some play between the parts 67 and 73 so that the adjusting device 67 is not likely to jam in the bore 68 and the width of the gap 69 equals or approximates an optimum value in spite of axial movability of the adjusting device.

In order to enable a person behind the end wall 53 of the cover 2 to observe the light-emitting diode 59, the latter is inserted into the smaller-diameter inner portion of a bore in an externally threaded nipple 75 meshing with an internal thread of the end wall 53. The larger-diameter portion of the bore in the nipple 75 contains a solid cylindrical plug 76 of glass or another suitable light-transmitting material. The elongated cylindrical external surface of the plug 76 and the cylindrical internal surface of the nipple 75 define a cylindrical gap 77 which is again dimensioned and configurated in such a way that it prevents the propagation of ignition between the internal space 49 of the capsule or enclosure E and the surrounding atmosphere. The external thread of the nipple 75 and the complementary internal thread of the end wall 53 preferably define a further gap 78 which is dimensioned to prevent the propagation of ignition between the inner and outer sides of the end wall 53 forming part of the cover 2. The reference character 76*a* denotes a window or bore which is provided in the end wall 53 in line with the cylindrical plug 76 and diode 59 so as to enable an attendant to observe the condition of the diode.

The length of the cylindrical plug 76 can be readily selected in such a way that the insertion of such plug into the nipple 75 does not weaken the respective portion of the enclosure E, especially if the cylinder 76 is bonded to the internal surface of the nipple.

The central portion of the end wall 53 has an inwardly extending cylindrical or frustoconical protuberance 79 with an axial passage or bore the innermost portion of which is threaded, as at 80. The threads 80 mate with the external threads of an adjustable element 80*a* constituting the right-hand end portion of the stop 30, as viewed in FIG. 1. The smaller-diameter portion of the axial passage in the protuberance 79 receives a rotary adjusting device 81 which extends outwardly beyond the end wall 53 and is connected with a knob 83. The cylindrical internal surface surrounding the smaller-diameter portion of the passage in the protuberance 79 and the cylindrical external surface of the adjusting device 81 define a cylindrical gap 82 which is dimensioned to prevent the propagation of ignition between the space 49 and the surrounding atmosphere. The inner end portion 84 of the adjusting device 81 is or constitutes a forked coupling portion cooperating with a complementary coupling portion 84*a* of the adjustable end portion 80*a* of the stop 30 so that the latter can be moved axially in response to rotation and resulting axial displacement of the externally threaded end portion 80*a* when the operator decides to change the angular position of the knob 83 and thus change the stroke of the cupped member 27, i.e., the extent of deformation of the diaphragm 9 and the extent to which the volume of the pumping chamber 10 is changed in response to deformation of the diaphragm. At least some play is preferably provided between the portions 84, 84*a* of the coupling which transmits torque from the adjusting device 81 to the adjustable element 80*a* in response to clockwise or counterclockwise rotation of the knob 83. The advantage of such play is that the adjusting member 81 is not likely to change the width of the cylindrical gap 82 in response to rotation in the bore of the protuberance 79. The presence of some play between the coupling portions 84 and 84*a* does not adversely affect the ability of the adjusting device 81 to accurately select the axial position of the stop 30 by moving the adjustable element 80*a* axially in response to transmission of torque from the coupling portion 84 to the coupling portion 84*a*. The coupling portions 84, 84*a* cooperate properly even if they allow for some angular as well as axial movement of the adjusting device 81 with reference to the adjustable element 80*a*.

The lower portion of the cover 2, as viewed in FIG. 1, has two parallel bores or holes 85 and 86 for the terminals 88 of cables 88*a* for conductors 88*b*. FIG. 1 only shows a terminal 88 in the right-hand bore 86 and further shows a stopper or plug 87 in the left-hand bore 85. The bores 85, 86 have internal threads, and the parts 87, 88 have external threads which define with the respective internal threads a pair of gaps each having a width and axial length such as to prevent the propagation of ignition between the internal space 49 and the surrounding atmosphere. The conductors 88*b* are connected to the coil 16 and to certain components of the control unit 50 on the plate 51. If desired, the plug 87 and/or the terminal 88 can be sealingly secured to the cover 2 by a suitable adhesive which is preferably provided in addition to the aforediscussed external threads on such parts.

O-rings or otherwise configurated sealing elements can be installed in the gaps 61, 69, 82 and/or other gaps to prevent the penetration of moisture into the interior of the capsule or envelope E.

The dimensions and materials of the main portion 1 and cover 2 of the enclosure E are selected with a view to ensure that such parts can withstand serious damage as a result of an explosion in the internal space 49. For example, the cover 2 and the main portion 1 can be made of cast aluminum containing less than 6% manganese. It is also possible to make the cover 2 of a synthetic plastic material. The component 4 can be made of cast iron to avoid the generation of sparks in response to establishment of direct contact between the part 4 and cupped member 27. The plastic constituent of the aforementioned friction bearing 35 is preferably polytetrafluoroethylene. The cupped member 27 is preferably made of high-quality steel, and the sections 7, 8 of the pump head 6 can be made of acrylic glass, polyvinyl chloride, polytetrafluoroethylene or a high-quality steel. The cylindrical plug 76 can be made of a vitreous material or of a light-transmitting synthetic plastic substance, such as artificial glass. The antifriction bearing 32 preferably contains a cage or sleeve for a set of spherical rolling elements, and such cage or sleeve receives the smaller-diameter portion of the plunger 26 without any or with extremely small play. The shafts of the aforementioned adjusting devices 60, 67 and 81 preferably consist of a high-quality steel.

It will be noted that all electrical parts of the improved fluid flow machine are installed in the interior of the enclosure E which constitutes a pressure-resistant capsule. This satisfies the provisions of German DIN EN No. 50 018 norm as well as the requirements of corresponding norms of other countries. The enclosure E is designed to withstand the pressures which develop in the event of an explosion in the internal space 49, and the aforediscussed gaps 34, 40, 61, etc. prevent the propagation of flames and/or sparks from the internal space 49 to the surrounding atmosphere. While it is possible to provide an enclosure in addition to the aforedescribed parts, the provision of an enclosure (E) which includes the pump housing, the casing of the motor and the cover for the control unit contributes to simplicity, compactness and lower cost of the improved fluid flow machine. The ability of the enclosure to withstand pronounced pressures (e.g., the pressures which are likely to develop in the event of an explosion or fire in the internal space 49 of the enclosure) can be achieved by appropriate reinforcement of the constituents of the enclosure. This reinforcement does not contribute significantly to the mass and bulk of the machine because the main portion 1 and/or the cover 2 is normally reinforced by heat dissipating fins or ribs so that the wall thickness of the main portion 1 and cover 2 must be increased only slightly in order to ensure that the constituents 1 and 2 can resist the aforediscussed pressures. The configuration and dimensions of the various gaps are such that they invariably ensure the confinement of sparks and/or flames in the interior of the enclosure E. This necessitates certain departures from the design of conventional fluid flow machines but brings about the aforediscussed advantages, especially as concerns the usefulness of the improved machine in explosive atmospheres and under other circumstances when the propagation of ignition from the interior of the machine to the surrounding area and/or vice versa could cause much damage and/or injury. Thus, by the simple expedient of slightly increasing (if necessary) the wall thickness of the main portion 1 and/or cover 2 of the enclosure E, and by providing gaps which are sufficiently narrow and sufficiently long or deep to prevent the propagation of flames or sparks, one can avoid the need for a separate capsule for confinement of the fluid flow machine.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A fluid flow machine comprising a diaphragm pump having a diaphragm; means for driving said pump including electromagnet means having a movable armature and means for deforming said diaphragm in response to movement of said armature, said deforming means comprising a discrete motion transmitting member disposed between said diaphragm and said armature, a second member interposed between said motion transmitting member and said diaphragm and means for yieldably biasing said second member against said motion transmitting member, said motion transmitting member being located between said second member and said armature and being in contact with said second member and said armature solely under the action of said biasing means; a common, pressure-resistant enclosure for said pump and said driving means, said enclosure including a main portion, a cover and means for securing said cover to said main portion, said main portion having a first part surrounding at least a portion of said pump and a second part surrounding said electromagnet means, said second part comprising a peripheral wall which surrounds said electromagnet means, an end wall integral with said peripheral wall and disposed between said electromagnet means and said first part, and a sleeve integral with said end wall and projecting towards said first part, said sleeve having first and second sections and said motion transmitting member being movably mounted in said sleeve, the outer diameter of said motion transmitting member and the inner diameter of said first section being approximately equal to prevent the propagation of ignition between the interior of said second part and the interior of said first part of said enclosure, said cover being snugly interfitted with said main portion to prevent the propagation of ignition between the interior of said enclosure and the surrounding atmosphere, said main portion having a first cylindrical surface and said cover having a second cylindrical surface, one of said surfaces surrounding the other of said surfaces and the snug fit between said cover and said main portion being disposed between said surfaces; and bearing means in said second section of said sleeve arranged to guide said motion transmitting member.

2. The machine of claim 1, wherein said cover includes a tubular extension having an external surface which constitutes said second surface, and said main portion includes a tubular end portion having an internal surface which constitutes said first surface.

3. The machine of claim 1, wherein said main portion and said cover further have closely adjacent neighboring third and fourth surfaces extending substantially radially from said first and second surfaces to the atmoshpere.

4. The machine of claim 3, wherein said fourth surface is an annular shoulder of said cover and said second surface is a cylindrical external surface which is radially inwardly adjacent to said shoulder, said third surface constituting an end face of said main portion and said first surface constituting a cylindrical internal surface which is radially inwardly adjacent to said third surface.

5. The machine of claim 1, wherein said enclosure has an external surface including a polygonal portion, each of said first and second surfaces including first and second portions which are respectively nearer to and more distant from said polygonal portion and said securing means including fastener means outwardly adjacent to the second portions of said first and second surfaces.

6. The machine of claim 1, wherein said bearing means includes an antifriction bearing.

7. The machine of claim 1, wherein said motion transmitting member consists of hardened stainless steel.

8. The machine of claim 1, wherein said second member is a cupped member and said biasing means comprises a spring reacting against said enclosure and bearing against said cupped member to bias the cupped member against said motion transmitting member.

9. The machine of claim 8, wherein said cupped member has a bottom wall which is connected to said diaphragm, and said motion transmitting member extends into said cupped member, said spring being arranged to maintain said bottom wall in contact with said motion transmitting member.

10. The machine of claim 9, further comprising a friction bearing spacedly surrounding said motion transmitting member, said bearing being installed between said cupped member and said main portion of said enclosure.

11. The machine of claim 10, wherein said cupped member consists of a high grade steel.

12. The machine of claim 10, wherein said bearing is a compound bronze-plastic friction bearing.

13. The machine of claim 8, further comprising a deformable membrane sealingly connecting said cupped member to said enclosure.

14. The machine of claim 1, wherein said main portion of said enclosure has an opening permitting gravitational outflow of fluids intermediate said diaphragm and the periphery of said motion transmitting member.

15. The machine of claim 1, further comprising at least one adjusting device extending from said enclosure, said device and said enclosure being closely adjacent to each other so as to prevent between them the propagaration of ignition from the interior of said enclosure to the atmosphere or vice versa.

16. The machine of claim 15, wherein said adjusting device has a cylindrical external surface and said cover has a bore, said cylindrical internal surface surrounding said bore, said enclosure and said adjusting means being closely adjacent to each other between said external and internal surfaces.

17. The machine of claim 16, further comprising an adjustable element in the interior of said enclosure, and coupling means connecting said adjustable element with said adjusting device in said enclosure.

18. The machine of claim 17, wherein said coupling means is arranged to allow for at least some play between said adjusting device and said adjustable element.

19. The machine of claim 17, further comprising a switch installed in said enclosure and including a portion which constitutes said adjustable element.

20. The machine of claim 19; wherein said adjustable element and said adjusting device are movable axially of said bore, and further comprising resilient means for biasing said adjusting device axially and away from said adjustable element to a predetermined starting position.

21. The machine of claim 17, wherein said adjustable element and said adjusting device are rotatable about the axis of said bore and said coupling means includes a forked torque transmitting portion.

22. The machine of claim 17, wherein said coupling means includes a plug-in torque transmitting connection between said adjusting device and said adjustable element.

23. The machine of claim 1, further comprising optical signal generating means in said enclosure, said enclosure having an observation window in line with said signal generating means and further comprising a light-transmitting device in said window, said light-transmitting device and said enclosure being closely adjacent to each other so as to prevent the propagation of ignition between them from the interior of said enclosure to the atmopshere or vice versa.

24. The machine of claim 23, wherein said is a bore in said cover, said cover having a cylindrical internal surface surrounding said bore and said light-transmitting device including an elongated cylinder having an external surface, said light transmitting device and said enclosure being closely adjacent to each other between said internal and external surfaces.

25. The machine of claim 1, further comprising heat-conducting means connecting said electromagnet means to said end wall.

26. The machine of claim 25, wherein said electromagnet means includes first and second end portions, said first end portion being connected to said end wall and; further comprising heat sensor means installed in said enclosure adjacent to the second end portion of said electromagnet means.

27. The machine of claim 1, wherein said pump is a metering pump.

28. The machine of claim 1, wherein said armature and said member are mounted for reciprocation.

* * * * *